United States Patent [19]

Pezzoli et al.

[11] Patent Number: 4,951,845

[45] Date of Patent: Aug. 28, 1990

[54] CLOSURE WITH FILTER

[75] Inventors: Paul A. Pezzoli, Worthington; Gary N. Smith, Dublin, both of Ohio; Jerold Montgomery, Libertyville, Ill.

[73] Assignee: Abbott Laboratories, Abbott Park, Ill.

[21] Appl. No.: 297,466

[22] Filed: Jan. 17, 1989

[51] Int. Cl.[5] ..... B65D 41/20

[52] U.S. Cl. ..... 215/250; 215/309

[58] Field of Search ..... 215/247, 248, 250, 308, 215/309; 604/405, 415

[56] References Cited

U.S. PATENT DOCUMENTS

| | | | |
|---|---|---|---|
| 2,135,386 | 11/1938 | Crabbe | 215/247 |
| 2,812,117 | 11/1957 | Butkus | 604/405 X |
| 3,709,395 | 1/1973 | Brennan et al. | 216/247 |
| 4,235,344 | 11/1980 | Kulle et al. | 215/250 |

*Primary Examiner*—Donald F. Norton

*Attorney, Agent, or Firm*—Donald O. Nickey; Edward H. Gorman; Patrick Phillips

[57] ABSTRACT

An enteral delivery universal port assembly fabricated from a first portion and a second portion of different materials. The first portion has a generally cylindrical side wall, an annular top surface and a corresponding annular bottom surface. The second portion has a central portion with a peripheral flange extending radially outward therefrom, and an annular portion positionable is superposed adjacent relationship to the annular bottom surface. Extending upwardly from the surface of the central portion are first and second projections, the first projection having a base which is a spikable membrane and the second projection being associated with filter means which allow air to enter the enteral nutritional product container to which the enteral delivery universal port assembly is secured in its operative embodiment.

14 Claims, 3 Drawing Sheets

CLOSURE WITH FILTER

TECHNICAL FIELD

The present invention relates generally to an enteral delivery universal port assembly, and more particularly, to a closure which features a cooperating retaining ring and a separate combination port/gasket fabricated of different materials.

BACKGROUND ART

Many individuals in health care facilities are able to achieve sufficient caloric intake through eating prepared meals. However, a sizable number of such patients are unable to ingest enough food to meet their body's needs. Examples of these individuals would include burn patients, whose daily caloric needs are often in excess of 5,000 calories, and critically ill, weak, or comatose patients who may be unable to chew their food. For these patients, caloric supplementation through parenteral, also known as intravenous, feeding is not a viable alternative.

In response to this problem, liquid foods have been developed for enteral feeding. Enteral feeding is providing nourishment through the oral tract by defined nutritional diets. Typically, enteral feeding utilizes a nasogastric tube to transport the liquid nutritional products from the container through the patient's nasal cavity and thence into the stomach. Early enteral nutritional product containers were empty, sterilized pouches which were filled with sterilized, canned product at the point of use. The filled pouch was spiked by a cannula. However, there are shortcomings associated with that type of packaging including potential product contamination and extensive set-up-time. In response to that problem, a multi-layer plastic bottle was developed having a central layer which provided an oxygen barrier, therefore permitting the bottle to be pre-filled with food product which provided greater shelf-life and less spoilage. This type of plastic bottle utilizes an attached membrane which must be pierced so as to permit the commencement of the feeding process.

Ported closures are well known, an example of which is Steidley, U.S. Pat. No. 4,022,258 which discloses a closure for surgical irrigation fluid containers as opposed to one for enteral nutritional product containers. Steidley discloses a large spike member which can pierce a plastic cap with the spike member including a conventional filter positioned adjacent the external surface of the cap. However, Steidley does not address the unique problems associated with the physical composition of enteral nutritional products. Enteral nutritional products are dissimilar from fluids introduced by intravenous feeding primarily due to the presence of minerals and other solids which tend to form a sediment which settles to the bottom of the inverted container during feeding. Additionally, enteral nutritional products are extremely viscous.

Current enteral nutritional product containers utilize one-piece injection molded, relatively rigid plastic threaded caps. The caps are often pre-attached to the plastic tubing of a delivery set, thus not permitting the use of "spike"-type feeding sets. Even in the cases of caps designed for use with "spike"-type feeding sets, there are three major drawbacks. First, due to the desirability of obtaining a leakproof seal, significant torque must be applied to the threaded portion of the cap, however this requires the cap to be fabricated from a relatively rigid plastic which may prove difficult for nurses to easily cannulate. Second, conventional closures for enteral nutritional containers utilize a gasket which is maintained in position by a centrally located annular ring which depends downwardly from the bottom surface of the cap. However, in shipping, the annular ring may either accidentally puncture the membrane if sufficient downward pressure is applied to the cap, or the ring may downwardly deform the membrane enough such that after cannulation has occurred, air may inadvertently find its way into the nasogastric tube resulting in aspiration of the patient. Third, even if the above drawbacks are overcome, if the diameter of the cannula is too wide to pierce the cap's membrane or too narrow to remain engaged with the container, "spike"-type feeding must be abandoned or a completely new one-piece cap must be obtained that can accommodate the diameter of the cannula. Existing one-piece closures cannot overcome the above disadvantages.

It is thus apparent that the need exists for an improved closure for pre-filled enteral nutritional product containers which ensures a leakproof seal as well as easy cannulation, while at the same time overcoming the drawbacks associated with existing one-piece closures.

DISCLOSURE OF THE INVENTION

There is disclosed a closure for a product container, said closure comprising, a first portion, said first portion having a generally cylindrical side wall, said side wall having threads along the inner surface thereof for threadedly engaging the neck of said container, an annular top surface, and a corresponding annular bottom surface, and a second portion, said second portion having a central portion and an annular portion, said central portion having an upper surface and said annular portion having an annular top portion, said annular top portion positioned beneath said annular bottom surface.

There is also disclosed a closure for a container, said closure comprising, a first portion having a generally cylindrical side wall, said side wall having threads along the inner surface thereof for threadedly engaging the neck of said container, an annular top surface and a corresponding annular bottom surface, and a second portion having a central portion and an annular portion, said central portion having an upper surface and said annular portion having an annular top portion, said annular top portion positioned beneath said annular bottom surface.

There is also disclosed a closure for an enteral nutritional product container, said container comprising, a first portion, said first portion having a generally cylindrical side wall, said side wall having threads along the inner surface thereof for threadedly engaging the neck of said container, an annular top surface having a peripheral outer edge and a corresponding annular bottom surface, and a second portion, said second portion having a central portion in friction-fit engagement with said first portion, a lower surface and an annular portion, the improvement characterized in that said central portion has an upper surface with first and second projections extending upwardly therefrom, and a peripheral flange extending radially outwardly therefrom with the distance between said flange and said annular top portion being approximately the distance between said annular top surface and said annular bottom surface, said annular portion having an annular top portion, said annular top portion positioned beneath said annular bottom surface, said first portion and said second portion being fabricated from different materials.

Additionally, the first projection has a base which is a spikable membrane and the second projection is associated with filter means which allows air to enter the container. Furthermore, the first portion is preferably fabricated from a rigid plastic.

The present invention provides an enteral delivery universal port assembly which ensures a leakproof seal as well as easy cannulation, while at the same time overcoming the drawbacks associated with existing one-piece closures.

Other aspects and advantages of the invention will be apparent from the following description, the accompanying drawings and the appended claims.

DETAILED DESCRIPTION OF THE INVENTION

Figure 1:
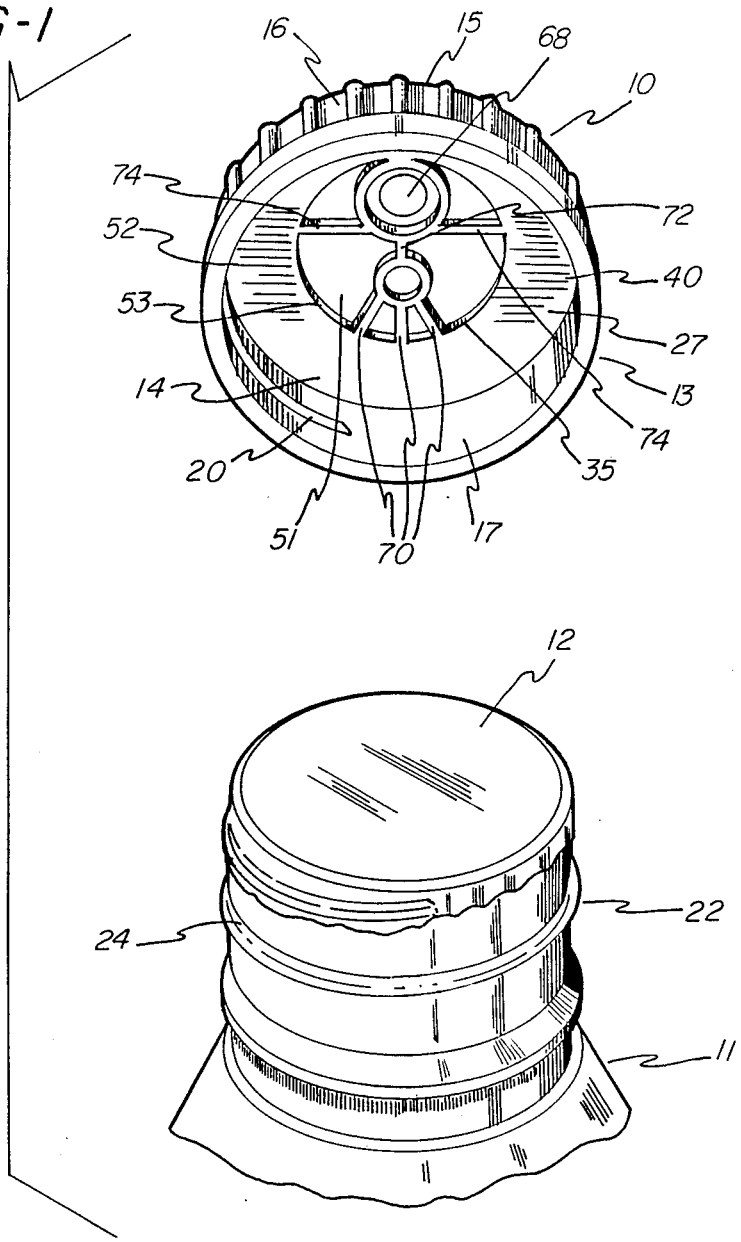
FIG. 1 is a perspective view of the closure which is utilized in an enteral delivery universal port assembly in accordance with the present invention shown with a portion of an enteral nutritional product container.

Having reference to the drawings, attention is directed first to FIG. 1 which illustrates a closure for an enteral delivery universal port assembly embodying this invention designated generally by the numeral 10, as shown in conjunction with a portion of an enteral nutritional product container 11. The container 11 has a membrane seal 12 which typically is of foil or of thin plastic.

The closure 10 includes as basic components thereof, first portion 13 and second portion 14. First portion 13 includes a cylindrical side wall 15 having an outer surface 16 as well as an inner surface 17. Along the inner surface 17 are threads 20 for threadedly engaging the closure 10 to the neck 22 of the container 11 at the threaded neck portion thereof 24.

Figure 2:
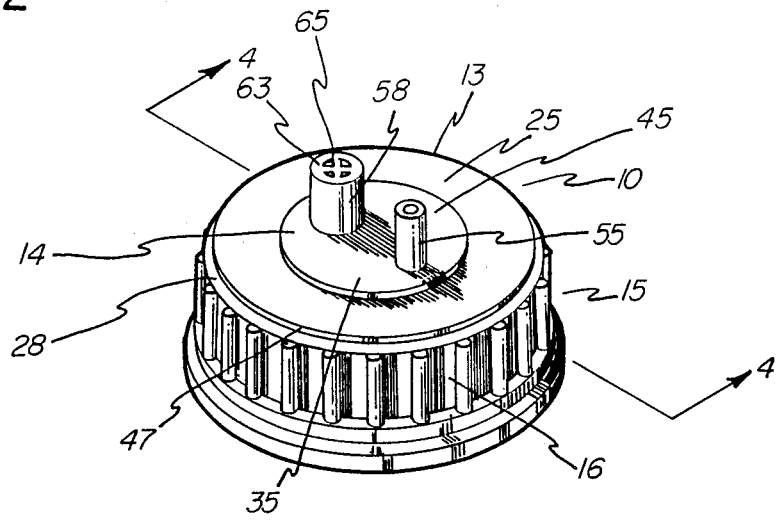
FIG. 2 is a top elevational view of the closure shown in FIG. 1.
Figure 3:
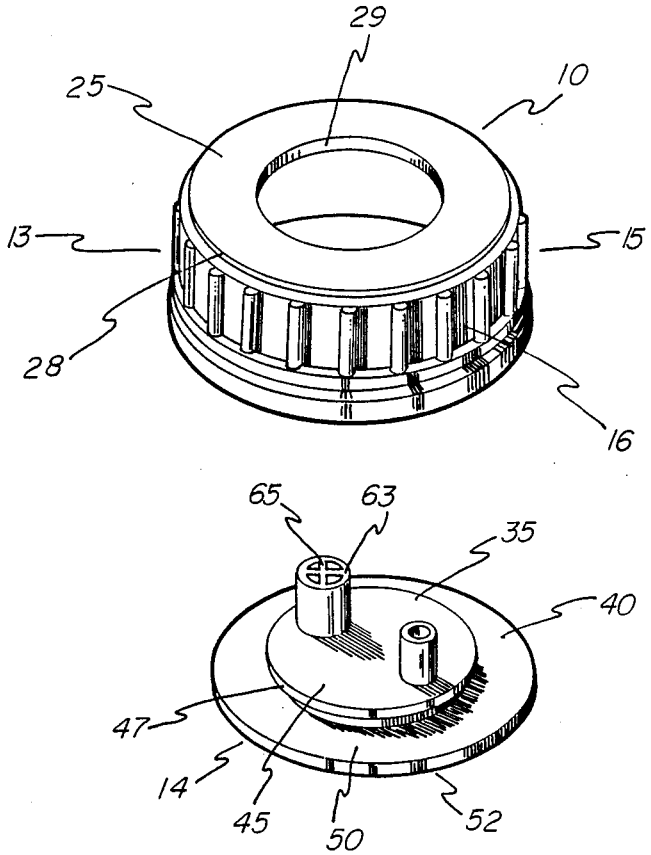
FIG. 3 is a top elevational view of the two major components of the closure, shown prior to their being assembled into the operative embodiment of the closure shown in FIG. 2.

As can be better seen in FIGS. 2 and 3, first portion 13 also includes an annular top surface 25 along with corresponding annular bottom surface 27. Annular top surface 25 has a peripheral outer edge 28 from which depends downwardly outer surface 16 of the cylindrical side wall 15. Between annular top surface 25 and annular bottom surface 27 is inner annular wall 29 which preferably is normal with respect to the two surfaces between which it extends.

The first portion 13 may be injection molded of a rigid thermoplastic polymer, e.g. polypropylene, nylon or acrylonitrile-butadiene-styrene (ABS). The relative rigidity of the first portion permits proper torque to be applied, thus accomplishing a leakproof seal. Additionally, with respect to general appearance, the first portion of this invention resembles the cylinder side walls of existing closures for enteral delivery assemblies.

As can be seen in FIGS. 2 and 3, the second portion includes a central portion 35 and an annular portion 40, wherein the central portion extends above the annular portion 40. Central portion 35 is shown as having a planar upper surface 45 with a peripheral flange 47 extending outwardly from the central portion. Annular portion 40, which essentially forms a gasket for the cap, is disclosed as having annular top portion 50, a recessed planar portion 51 and a lower portion 52.

In the operative embodiment of this invention shown in FIG. 2, annular top portion 50 is positionable in superposed, directly adjacent relationship to the annular bottom surface 2B of first portion 13. Referring again to FIG. 1, it will be appreciated that the distance between peripheral flange 47 and annular top portion 50 is approximately the same distance as between annular top surface 25 and annular bottom surface 27. Furthermore, extending upwardly from lower portion 52 to recessed planar portion 51 is recessed side wall 53.

Extending upwardly from upper surface 45 are first projection 55 and second projection 58. First projection 55 resembles conventional projections associated with cannulation of the closure, with the base 60 of first projection 55 forming a spikable or piercable membrane, with this membrane 60 being slightly recessed from lower portion 52.

Figure 4:
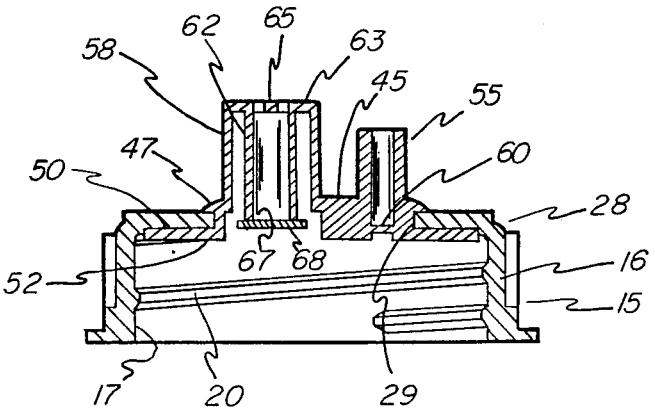
FIG. 4 is a vertical sectional view taken along line 4—4 of FIG. 2.

Second projection 5B is also of a generally cylindrical configuration. As can best be seen in FIG. 4, second projection 58 includes an interior cylinder 62 depending downwardly from filter means top 63. Filter means top 63 also includes an air-grate 65 to assist in limiting the atmospheric air access to the container once the membrane seal is opened. While air-grate 65 is at the top of interior cylinder 62, the bottom of interior cylinder 62 discloses an opening 67 across which is stretched filter 68. The microbial filter 6B is preferably woven from a synthetic fiber material, and secured to the plastic by being heat staked.

As can best be seen in FIG. 1, a plurality of membrane support members 70 extend from recessed side wall 53 to that portion of first projection 55 located between recessed planar portion 51 and lower portion 52. An additional center support member 72 extends between the portion of first projection 55 located between recessed planar portion 51 and lower portion 52 and that section of second projection 5B which also extends between recessed planar portion 51 and lower portion 52. Further support for the section of second projection 5B which extends between recessed planar portion 51 and lower portion 52 is provided by filter support member 74 which extend between the aforementioned section of the second proJection 58 and recessed side wall 53.

In the preferred embodiment of the invention, the material from which second portion 14 is fabricated is different than that of first portion 13. Preferably second portion 14 is fabricated from a more flexible plastic than is the first portion 13, with an example of such a plastic being ethylene vinyl acetate or another thermoplastic elastomer such as styrene block copolymer, or a polymer blend such as polypropylene-ethylene-propylene rubber. Due to the flexible plastic of second portion 14, central portion 35 and first portion 13 are in friction-fit engagement with one another in the operative embodiment of the invention. Conversely, the flexible nature of second portion 14 permits it to be detachable from the first portion. This is especially important in instances where the cannula size is significantly larger or smaller than can be accommodated by first projection 55. In such instances, this invention permits the insertion of another flexible second portion, with this new snap-in insert having a first projection of a diameter able to be engaged with the desired cannula.

Best Mode

In actual operation, outer retaining ring 13 can be securely screwed onto an enteral nutritional product container 11. Meanwhile, the relatively smooth lower portion 52 of second portion 14 obviates the possibility of accidentally puncturing or piercing the membrane while the container is being shipped. Additionally, the smooth surface does not deform the membrane to increase the likelihood of air being able to enter into the nasogastric tube thereby aspirating the patient. Furthermore, the presence of second portion 14 permits easy cannulation by a health care professional. Once cannulation occurs, the container is inverted to allow for the passage of food product through first projection 55.

Industrial Applicability

This $500,000,000 industry has long sought ways to ensure a leak proof seal while providing easy cannulation. This invention solves this long felt need. While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. A closure for a product container, said closure comprising, a first portion, said first portion having a generally cylindrical side wall, said side wall having threads along the inner surface thereof for threadedly engaging the neck of said container, an annular top surface, and a corresponding annular bottom surface, and a second portion, said second portion having a central portion and an annular portion, said central portion having first and second projections extending upwardly therefrom, and an upper surface said annular portion having an annular top portion, said annular top portion positioned beneath said annular bottom surface.

2. The closure as claimed in claim 1 wherein said central portion extends above said annular top portion.

3. The closure as claimed in claim 2 wherein said annular top surface has a peripheral outer edge, said generally cylindrical side wall depending downwardly from said peripheral outer edge.

4. The closure as claimed in claim 2 wherein said annular top portion is positionable in superposed adjacent relationship to said annular bottom surface.

5. The closure as claimed in claim 2 wherein said first portion is fabricated from a rigid plastic.

6. The closure as claimed in claim 5 wherein said second portion is fabricated from a different material than is said first portion.

7. The closure as claimed in claim 6 wherein said second portion is fabricated from a more flexible plastic than said first portion.

8. The closure as claimed in claim 1 wherein said first projection has a base which is a spikable membrane, and said second projection is associated with filter means which allows air to enter said container.

9. The closure as claimed in claim 8 wherein said central portion and said first portion are in friction-fit engagement with one another.

10. The closure as claimed in claim 9 wherein said second portion has a lower surface, said lower surface being planar and extending beneath said central portion and said annular portion.

11. The closure as claimed in claim 10 wherein said first portion and said second portion are detachable from one another.

12. The closure as claimed in claim 11 wherein said central portion has a peripheral flange extending radially outwardly therefrom with the distance between said flange and said annular top portion being approximately the distance between said annular top surface and said annular bottom surface.

13. A closure for a container, said closure comprising, a first portion having a generally cylindrical sidewall, said side wall having threads along the inner surface thereof for threadedly engaging the neck of said container, an annular top surface and a corresponding annular bottom surface, and a second portion having a central portion and an annular portion, said central portion having first and second projections extending upwardly therefrom and an upper surface said annular portion having an annular top portion, said annular top portion positioned beneath said annular bottom surface.

14. A closure for an enteral nutritional product container, said closure comprising, a first portion, said first portion having a generally cylindrical side wall, said side wall having threads along the inner surface thereof for threadedly engaging the neck of said container, an annular top surface having a peripheral outer edge and a corresponding annular bottom surface, and a second portion, said second portion having a central portion in friction-fit engagement with said first portion, a lower surface and an annular portion, the improvement characterized in that said central portion has an upper surface with first and second projections extending upwardly therefrom, and a peripheral flange extending radially outwardly therefrom with the distance between said flange and said annular top portion being approximately the distance between said annular top surface and said annular bottom surface, said annular portion having an annular top portion, said annular top portion positioned beneath said annular bottom surface, said first portion and said second portion being fabricated from different materials.

* * * * *

UNITED STATES PATENT AND TRADEMARK OFFICE

CERTIFICATE OF CORRECTION

PATENT NO. : 4,951,845

DATED : August 28, 1990

INVENTOR(S) : Paul A. Pezzoli; Gary N. Smith; Jerold Montgomery

It is certified that error appears in the above-identified patent and that said Letters Patent is hereby corrected as shown below:

| | | |
|---|---|---|
| Column 4 | Line 9 | bottom surface "2B" to --28-- |
| Column 4 | Line 23 | Second projection "5B" to --58-- |
| | Line 32 | 68. The microbial filter "6B" to --68-- |
| | Line 42 | and that section of second projection "5B" to --58-- |
| | Line 45 | projection "5B" to --58-- |

Signed and Sealed this

Thirtieth Day of April, 1991

*Attest:*

*Attesting Officer*

HARRY F. MANBECK, JR.

*Commissioner of Patents and Trademarks*